US005484138A

United States Patent [19]

Soofi et al.

[11] Patent Number: 5,484,138

[45] Date of Patent: Jan. 16, 1996

[54] CONSUMABLE FORM WITH ADJUSTABLE WALLS

[75] Inventors: Madjid Soofi, St. Charles, Ill.; James S. Irwin, Hinckley, Ohio; Charles W. Connors, Jr., Chicago, Ill.

[73] Assignee: Magneco/Metrel, Inc., Addison, Ill.

[21] Appl. No.: 308,755

[22] Filed: Sep. 19, 1994

Related U.S. Application Data

[63] Continuation-in-part of Ser. No. 156,563, Nov. 22, 1993.

[51] Int. Cl.[6] ..... C21B 7/04

[52] U.S. Cl. ..... 266/281; 266/DIG. 1; 266/44

[58] Field of Search ..... 266/280, 281, 266/275, 44, DIG. 1; 264/30

[56] References Cited

U.S. PATENT DOCUMENTS

| | | | |
|---|---|---|---|
| 1,552,064 | 9/1925 | Lake | 249/62 |
| 1,643,425 | 9/1927 | Summey | 264/317 |
| 1,656,312 | 1/1928 | Black . | |
| 1,678,976 | 7/1928 | Durfee . | |
| 1,710,931 | 4/1929 | Klein . | |
| 2,301,101 | 11/1942 | Welshans | 22/147 |
| 3,396,961 | 8/1968 | Farrington | 266/42 |
| 3,492,383 | 1/1970 | Heimgartner | 264/30 |
| 3,672,649 | 6/1972 | Allen | 263/46 |
| 3,703,348 | 11/1972 | Pivar | 425/173 |
| 3,836,612 | 9/1974 | Mann | 264/30 |
| 3,885,016 | 5/1975 | Pivar | 264/269 |
| 3,916,047 | 10/1975 | Niesen | 428/35 |
| 4,012,029 | 3/1977 | Segwin et al. | 266/281 |
| 4,078,292 | 3/1978 | Porter | 29/402 |
| 4,279,844 | 7/1981 | Danjyo et al. | 264/30 |
| 4,364,798 | 12/1982 | Costa | 202/267 |
| 4,438,906 | 3/1984 | English | 266/44 |
| 4,452,050 | 4/1984 | Takuo | 264/30 |
| 4,469,309 | 9/1984 | Takashima et al. | 266/281 |
| 4,480,820 | 11/1984 | Zhukov et al. | 266/44 |
| 4,783,061 | 11/1988 | LaBate et al. | 266/281 |
| 5,360,200 | 11/1994 | Kloth et al. | 266/281 |

FOREIGN PATENT DOCUMENTS

| | | | |
|---|---|---|---|
| 0116722 | 3/1943 | Australia | 264/317 |
| 0064863 | 11/1982 | European Pat. Off. . | |
| 2435532 | 2/1976 | Germany | 147/264 |
| 2512841 | 9/1976 | Germany | 147/264 |
| 2659205 | 7/1977 | Germany . | |
| 44-9646 | 5/1969 | Japan . | |
| 53-113808 | 10/1978 | Japan . | |
| 57-72758 | 5/1982 | Japan . | |
| 59-156969 | 9/1984 | Japan . | |
| 60-096580 | 5/1985 | Japan . | |
| 60-137865 | 7/1985 | Japan . | |
| 0969453 | 10/1982 | U.S.S.R. . | |
| 1415431 | 11/1975 | United Kingdom . | |
| 1513210 | 6/1978 | United Kingdom . | |
| 2105828 | 3/1983 | United Kingdom . | |
| WO85/02397 | 6/1985 | WIPO . | |

OTHER PUBLICATIONS

"Stay Form" Spec–Data Sheet by Alabama Metal Industries Corp. (Feb. 1989).

Abstract of Japanese publication JP63154258, Patent Abstracts of Japan, vol. 01246, (M–759) published Apr. 11, 1988.

*Primary Examiner*—Scott Kastler

*Attorney, Agent, or Firm*—Maxwell J. Petersen; Willian Brinks Hofer Gilson & Lione

[57] ABSTRACT

An adjustable form used for forming or repairing a refractory lining includes an adjustable frame constructed from a plurality of intersecting beams, at least some of which are adjustable, and a form connected to the adjustable frame. The frame can be adjusted in at least one direction and, preferably, in more than one direction. By properly adjusting the frame, the adjustable form can be used to form a refractory lining in different metal containment devices varying in dimensions, and can also be used to repair existing refractory linings. The adjustable form is inserted into a metal containment device at a distance from the floor and walls of the metal containment device, and refractory material is poured into the space between the adjustable form and the metal containment device.

20 Claims, 4 Drawing Sheets

CONSUMABLE FORM WITH ADJUSTABLE WALLS

RELATED APPLICATION

This application is a continuation-in-part of U.S. application Ser. No. 08/156,563, filed on Nov. 22, 1993, the contents of which are incorporated herein by reference.

FIELD OF THE INVENTION

This invention relates to a consumable form for installing a refractory lining in a metallurgical vessel. The consumable form of the invention has walls whose spacing can be adjusted to facilitate installation and removal of the form or its frame, and to permit adaptation of the form to a metallurgical vessel.

BACKGROUND OF THE INVENTION

The use of a preformed lining or "form" for installing a refractory lining adjacent to a brick surface, for example, in a chimney, duct or furnace, is described in U.S. Pat. No. 4,442,050, issued to Takuo. Initially, the work surface to be lined is surrounded by a screen member, such as a wire netting having suitable air escape openings. The screen member or "form" is positioned relative to the work surface so that the work surface and screen member define a space to be occupied by the refractory lining. Then, refractory material is poured or sprayed into the space, and caused to harden.

As discussed in the parent application, identified above, the lining of troughs, runners, ladles and other metallurgical vessels has conventionally involved use of heavy steel plates as molds or forms for installing refractory liners. These prior art heavy steel plates can now be replaced with a consumable form made using an open mesh, galvanized steel screen or another consumable material. The use of an open mesh material acting as the inner walls of a mold permits the drying of the refractory material to commence immediately after it is poured between the inner walls of the mold and the walls of the vessel. The consumable mesh material, which is not removed during the drying process, permits venting of moisture from the drying refractory material. The mesh material is not removed until it is later melted (consumed) by molten metal being introduced into the finished trough, runner or vessel.

Because the mesh screen is lightweight and the refractory casting compound is of a consistency that can be pumped into the mold cavity, cranes and hoppers are no longer needed in the construction of refractory linings for troughs, runners and vessels, thereby reducing the cost of such installations. However, the lightweight mesh material alone is not sturdy enough to withstand substantial bending and/or collapse caused by the weight and pressure exerted by the refractory casting composition as it is being poured. In order to provide structural support for the consumable form, the parent application discloses the use of a framework of rectangular tubes made of steel or another sturdy material, connected to the form using wire ties, and supported by the walls of the trough, runner or vessel being lined.

As further disclosed in the parent application, identified above, it is sometimes desired to use the consumable form a number of times for the lining of different troughs, runners or vessels. In those instances, the form can be covered with a plastic film or other low-friction material and removed immediately after the refractory liner sets, but before the refractory liner is heated, dried and cured. However, this re-use of the consumable form has been somewhat limited to the formation of different refractory liners having a single size and shape. This is because the rigid frame connected to and supporting the open-mesh material has not been readily adaptable to vessels, troughs or runners of different sizes or shapes.

SUMMARY OF THE INVENTION

The present invention is a consumable form whose frame is adjustable to a plurality of fixed positions, thereby permitting the form to be used and, if desired, re-used to line vessels, troughs and runners of different sizes and shapes, with a refractory lining. At least some of the tubes or beams used to construct the framework are adjustable in length. Preferably, these tubes or beams are provided with corresponding and engaging mating tubes or beams. Preferably, the beams and mating beams engage telescopically in order to maintain their alignment.

Each such beam, and/or corresponding mating beam, is provided with an adjusting mechanism which can be used to fix the position of the beam relative to the mating beam. Each beam and mating beam can be fixed in a plurality of different positions relative to each other. When the beams and corresponding mating beams are secured in a retracted position, the space between the walls of the form is correspondingly wider. When the beams and corresponding mating beams are secured in a more overlapping position, the space between the walls of the form becomes correspondingly narrower.

The adjustable form of the invention can, by properly adjusting the frame, be used in different metallurgical vessels, troughs, runners, etc. which have somewhat different dimensions. Also, the adjustable form is especially useful in situations requiring the repair of an existing refractory lining. Previously, it was sometimes difficult to repair existing linings because the rigid frame caused the consumable form to abut regions of the refractory liner that were not worn, preventing the refractory casting composition from being pumped into the worn regions. The adjustable form makes it possible to almost always create a path for pumping the refractory casting composition into the worn regions of an existing liner.

With the foregoing in mind, it is a feature and advantage of the invention to provide a consumable form which can be used to line different metallurgical containment vessels, troughs and runners having some variation in size and shape.

It is also a feature and advantage of the invention to provide a consumable form whose size can be adjusted in situ in a metallurgical vessel, etc., to fine tune the thickness of the refractory liner being formed.

It is also a feature and advantage of the invention to provide a consumable form whose size can be adjusted to permit optional formation of thicker or thinner refractory liners in the same molten metal containment device.

It is also a feature and advantage of the invention to provide a consumable form especially useful for repairing existing refractory liners, whose walls can be adjusted to facilitate easy flow of a refractory casting composition into the worn regions of the liners.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 1(*a*) is a cross-sectional view of a consumable form as used in FIG. 1 having a consumable screen mesh and a consumable lining.

FIG. 3(*a*) is an expanded view taken along the line 3(*a*)—3(*a*) in FIG. 3, and illustrates the operation of an adjusting mechanism.

DETAILED DESCRIPTION OF THE PRESENTLY PREFERRED EMBODIMENTS

Figure 1:
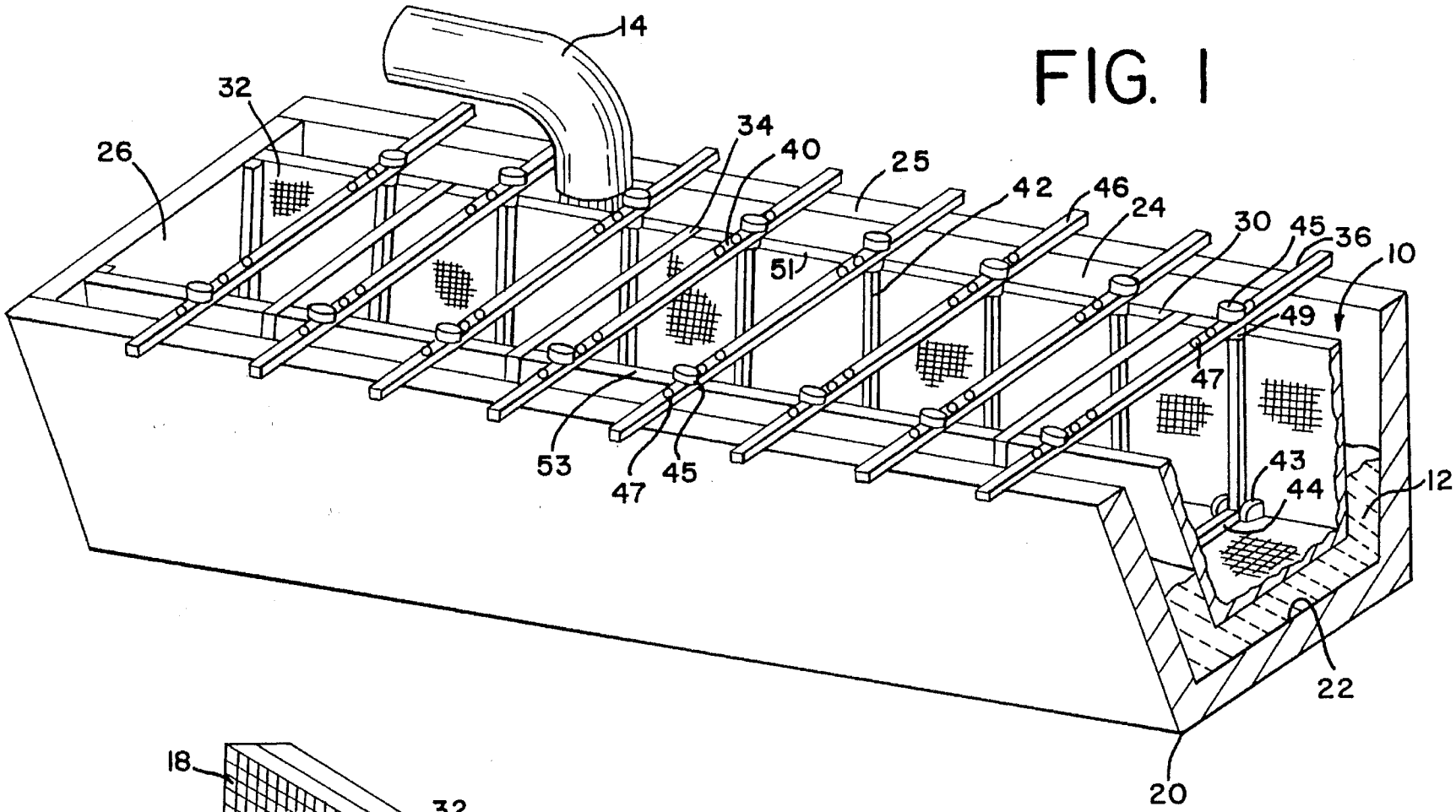
FIG. 1 is a partial perspective view showing one embodiment of an adjustable consumable form installed in a metallurgical vessel. A refractory casting material is being pumped between the consumable form and the inner surfaces of the metallurgical vessel.
Figure 1A:
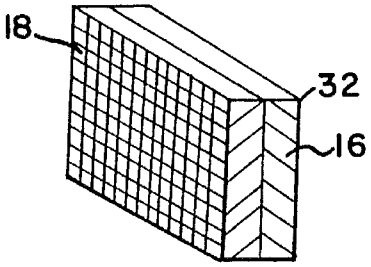

Referring to FIG. 1, a mold 10 for the installation of a refractory lining is defined by a metallurgical vessel 20 and an adjustable form 30 installed therein. The metallurgical vessel 20 includes a floor 22, side walls 24, and end walls 26, and is preferably constructed of steel. The adjustable form 30 includes an adjustable frame 40, preferably constructed of metal rods and/or pipes, and a flexible consumable form 32 wrapped around the adjustable frame 40 and strapped thereto using a plurality of one-inch wide plastic or metal bands 34.

The consumable form 32 can be constructed of any flexible, lightweight porous material, for example, an open-mesh screen made from plastic or metal. One suitable screen material is sold under the name "Stay-Form" by the Alabama Metal Industries Corp. of Birmingham, Ala. Other screen types, and other types of porous flexible material, can also be used. As disclosed in the parent application Ser. No. 08/156,163, the screen may be covered or lined with another flexible material, for example, shrink-wrap plastic, paper, or cloth, if it is desired to use the consumable form more than once. When used, this lining material covers the entire consumable form 32 and faces the floor and walls of the vessel 20, in order to facilitate removal of the consumable form 32 after use. Thus, as shown in FIG. 1(*a*), the consumable form 32 may include a screen member 18 and a lining member 16.

The adjustable frame 40 is constructed from a plurality of intersecting upright beams 42, lower cross-beams 44, and upper cross-beams 46, which are preferably rigid rods and/or tubes made from steel, Re-Bar, or another metal. In FIG. 1, the upper cross-beams overhang the top surfaces 25 of the vessel walls 24, causing the remainder of the adjustable form 30 (except for the upper cross-beams) to hang (i.e. be suspended) into the vessel 22 from the upper cross-beams 46. Preferably, some of the upper cross-beams 46 are fastened to the surfaces 25 using, for instance, screws 36. This way, the adjustable form 30 is prevented from moving significantly while the refractory casting material 12 is being injected into the mold defined by the form 30 and the vessel 20.

The upright beams 42 are preferably pivotally mounted to the lower cross-beams 44 using pivoting mechanisms 43. The upper cross-beams 46 are connected to the upright beams 42 using pins 45, each of which passes through an opening 47 in an upper cross-beam 46 and into an end opening 49 in a corresponding upright beam 42. As shown in FIG. 1, each upper cross-beam 46 includes a plurality of openings 47 at different positions. This permits adjustment of the upper cross-beams 46 relative to the upright beams 42 in a plurality of different intersecting positions, so that the sides 51 and 53 of the adjustable form 30 can be moved closer to, or further away from, each other by simply removing the pins 45 and reinserting them through different openings 47 on the upper cross-beams 46. In effect, the pins 45, openings 47 and end openings 49 serve as the adjusting mechanism for the adjustable form 30.

The straps 34 maintain the consumable form 32 in position adjacent to the adjustable frame 40 so that the entire form 30 can be adjusted by adjusting the frame. Attachment of the consumable form 32 to the adjustable frame 40 can also be accomplished using heat or wire ties. Alternatively, the frame 40 can be preadjusted before cladding and strapping the consumable form 32 to the frame 40. Once the form 30 is in place, and properly adjusted, the refractory material 12 can be injected into the mold 10 through a nozzle 14 which is supplied by a source (not shown).

Preferably, the refractory material is pumpable, and can be transported and injected continuously using a concrete pump or similar pump. A particularly suitable pumpable refractory composition is an alumina-based composition disclosed in U.S. Pat. No. 5,147,830, issued to Banerjee and Connors, Jr., the disclosure of which is incorporated herein by reference. The preferred refractory composition is available under the trade name METCAST from Magneco/Metrel, Inc. of Addison, Ill.

After the refractory material 12 has been completely installed in the mold 10, the refractory material 12 is allowed to harden and set in much the same fashion as the drying of cement. The hardening can be expedited using heat, but should be accomplished at a temperature not exceeding about 600° F. (lower if a plastic or paper liner 16 is used adjacent to the screen 18). After the refractory material 12 has set, the entire adjustable form 30 can be removed and later re-used. Alternatively, the straps 34 can be cut and only the adjustable frame 40 can be removed, leaving the consumable form 32 in place for later destruction when molten metal is poured into the vessel. Alternatively, the frame 40 can remain in place for later destruction with the consumable form 32. In other words, the frame itself can be consumable.

When the consumable form 32 is to be re-used, the form 32 should include the liner 16 as well as the screen 18, and should be removed as soon as possible after the refractory material hardens so that drying can be completed without interference from the liner. When the consumable form 32 will not be re-used, the form 32 should include only the screen 18 without the liner 16, and can be left in place during drying because the open-mesh screen will not hinder evaporation. After the refractory material has set and dried, and at least the frame 40 has been removed, the refractory layer 12 can be baked.

If the refractory material disclosed in U.S. Pat. No. 5,147,830 is used, it is recommended that the refractory material be allowed to set for about 1–2 hours, then dried at room temperature for up to about four more hours, then baked at a higher temperature (above 250° F.) for about 5–30 hours. The preferred drying and baking times will vary depending on the shape and thickness of the refractory layer being formed.

Figure 2:
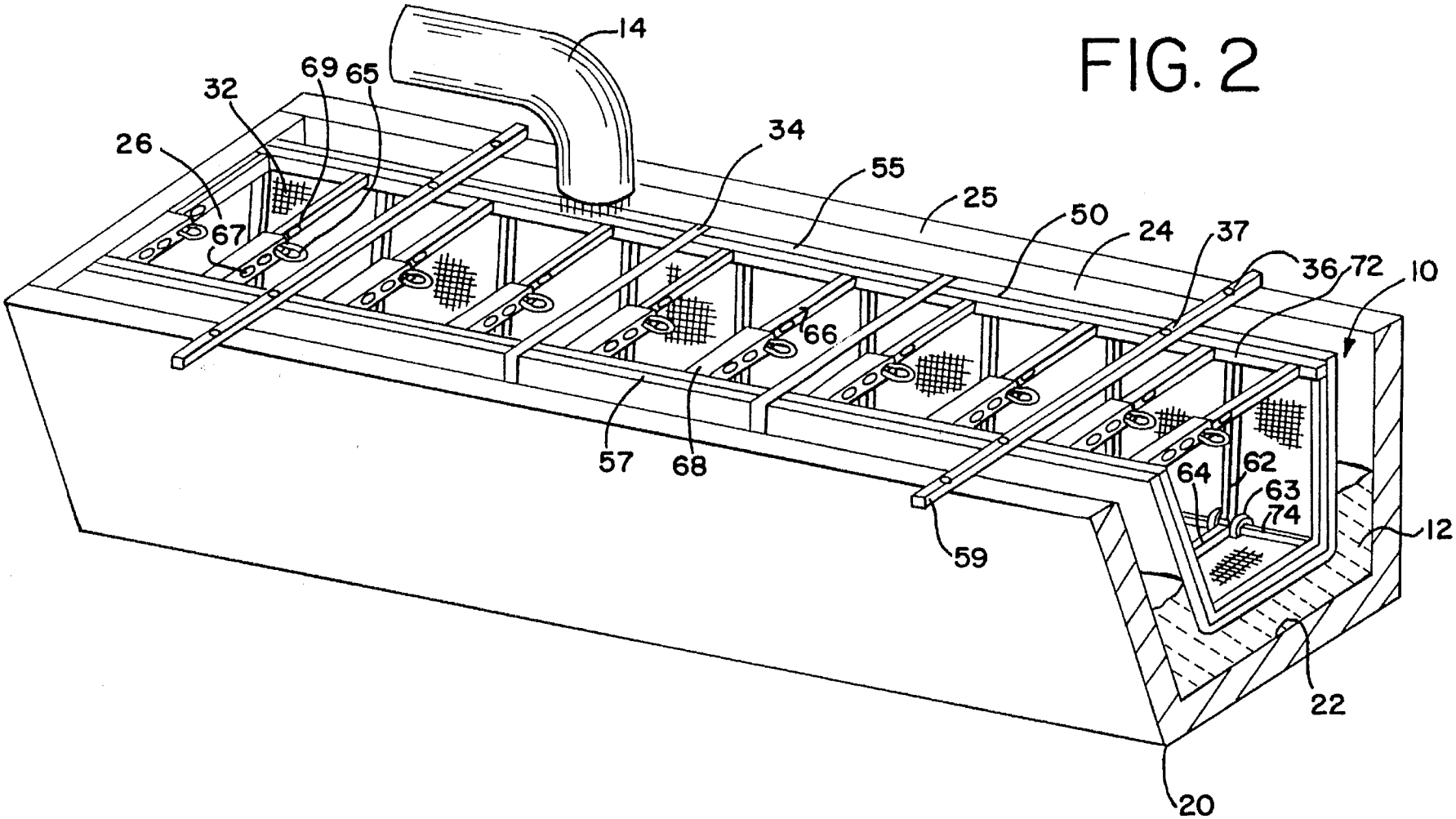
FIG. 2 is a partial perspective view of an alternative embodiment of an adjustable consumable form installed in a metallurgical vessel.
Figures 3, 3A:
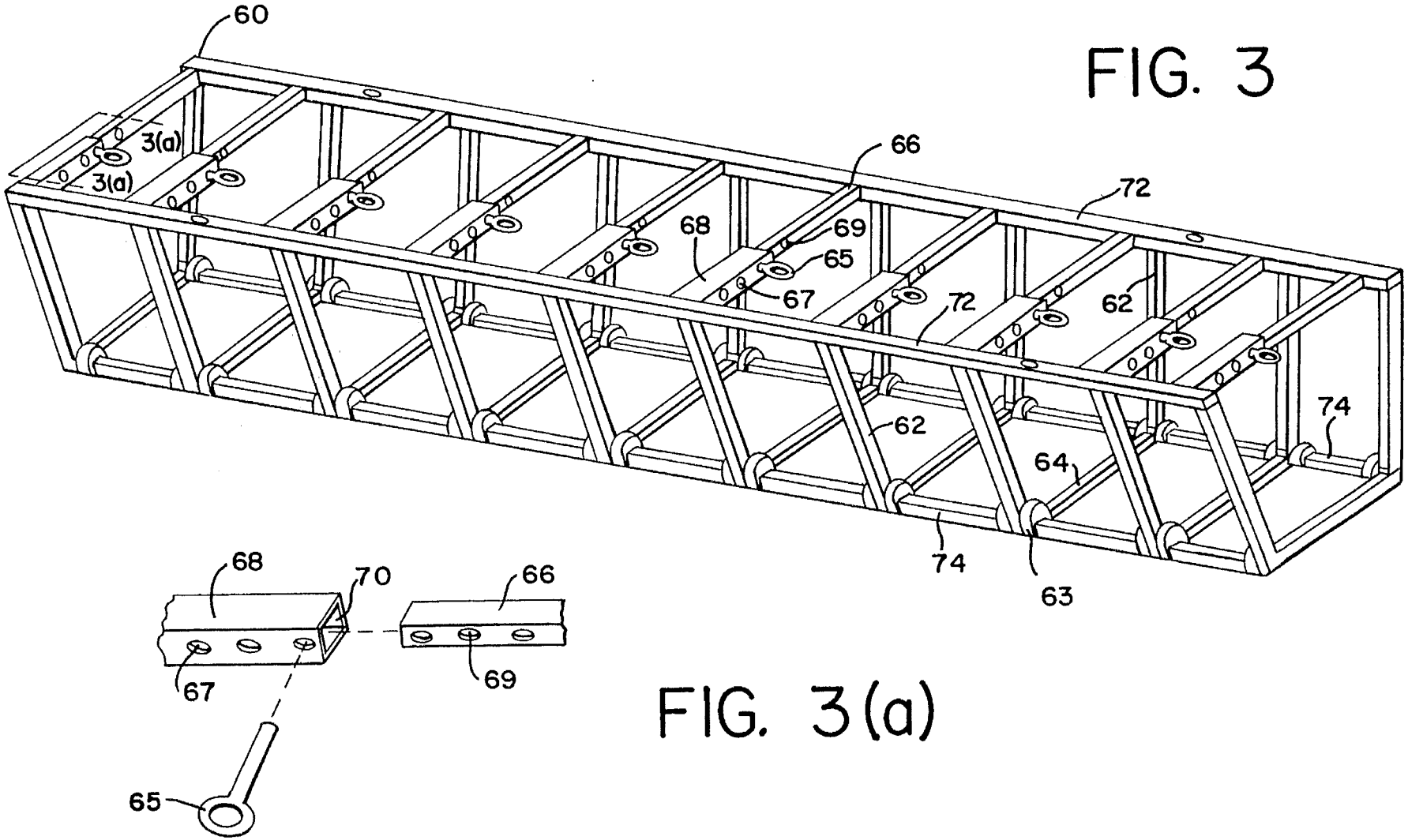
FIG. 3 is a perspective view of the adjustable frame used to support the adjustable consumable form in FIG. 2.

FIGS. 2, 3 and 3(*a*) illustrate a further embodiment of the invention in which the adjustable frame 60 has a different configuration than the adjustable frame 40 in FIG. 1. The reference numerals in FIG. 2 which also correspond to FIG. 1 indicate items which are the same as in FIG. 1, and which are described above. Only the frame 60 in FIG. 2 has been changed from FIG. 1.

Referring to FIGS. 2, 3 and 3(*a*), the adjustable frame 60 is constructed from a plurality of intersecting upright beams 62, lower cross-beams 64, upper cross-beams 66, mating beams 68 telescopically engaging the upper cross-beams 66, upper long beams 72 and lower long beams 74. Again, the beams are preferably rigid rods and/or tubes made from steel, Re-Bar, or another metal. The upright beams 62 are preferably pivotally mounted relative to the lower cross-beams 64 using pivoting mechanisms 63 which, in turn, are mounted on the lower long beams 74.

The lower long beams 74 extend the length of the frame 60 and intersect with, and support, the upright beams 62 and the lower cross-beams 64. The upper long beams 72 also extend the length of the frame 60 and intersect with, and are affixed to, the upright beams 62. One of the upper long beams 72 intersects with, and is affixed to, the upper cross-beams 66. The other upper long beam 72 intersects with, and is affixed to, the mating beams 68 which telescopically engage the upper cross-beams 66.

The frame 60 operates in much the same fashion as the frame 40, described above, except for a different adjusting mechanism. Adjustment of the frame 60 involves the upper cross-beams 66, the telescopically engaging mating 68, and a plurality of pins 65 which fix the position of the cross beams 66 and mating beams 68 relative to each other. Each mating beam 68 includes a plurality of openings 67 through which a pin 65 can pass. Each upper cross-beam 66 also includes a plurality of opening 69.

Referring to FIG. 3(*a*), each upper cross-beam 66 is inserted into telescope opening 70 in the corresponding mating beam 68 until at least one opening 69 aligns with an opening 67. Then, a pin 65 is inserted through the openings 67 and 69 to secure the mating beam 68 to the cross-beam 66. The distance between the sides 55 and 57 of the adjustable form 50 can be changed by removing the pins 65, and changing the amount of telescopic engagement between the cross-beams 66 and mating beams 68 before reinserting the pins 65.

Unlike the frame 40, described above, the upper cross-beams 66 of the frame 60 do not overhang the upper surfaces 25 of the vessel 20. Instead, the hanging and suspension of the adjustable form 50 is accomplished with a plurality of hanging boards or beams 59. Each board or beam 59 is secured to the frame 60 of the adjustable form 50 using screws or bolts 37 which fasten the board or beam 59 to the upper long beams 72. Each board or beam 59 also overhangs the upper surfaces 25 of the vessel walls, and can be secured to the surface 25 using the screws 36.

Except for the parts of the frame 60 used in the adjustment, i.e., the telescopically engaging upper cross-beams 66 and mating beams 68, and the pivoting mechanisms 63, the remaining parts of the frame 60 are usually more firmly mounted to each other, for example, by welding. The frame 60 can be adjusted to a variety of positions in order to facilitate use of the adjustable form 60 in wider or narrower metal containment devices (vessels, spouts, runners, ladles, etc). Also, the adjustment can be made in situ in a metal containment device when, for example, an existing refractory liner is being repaired and the operator is having difficulty injecting the refractory material to the worn portions of the existing liner due to obstruction from the unworn portions.

Figure 4:
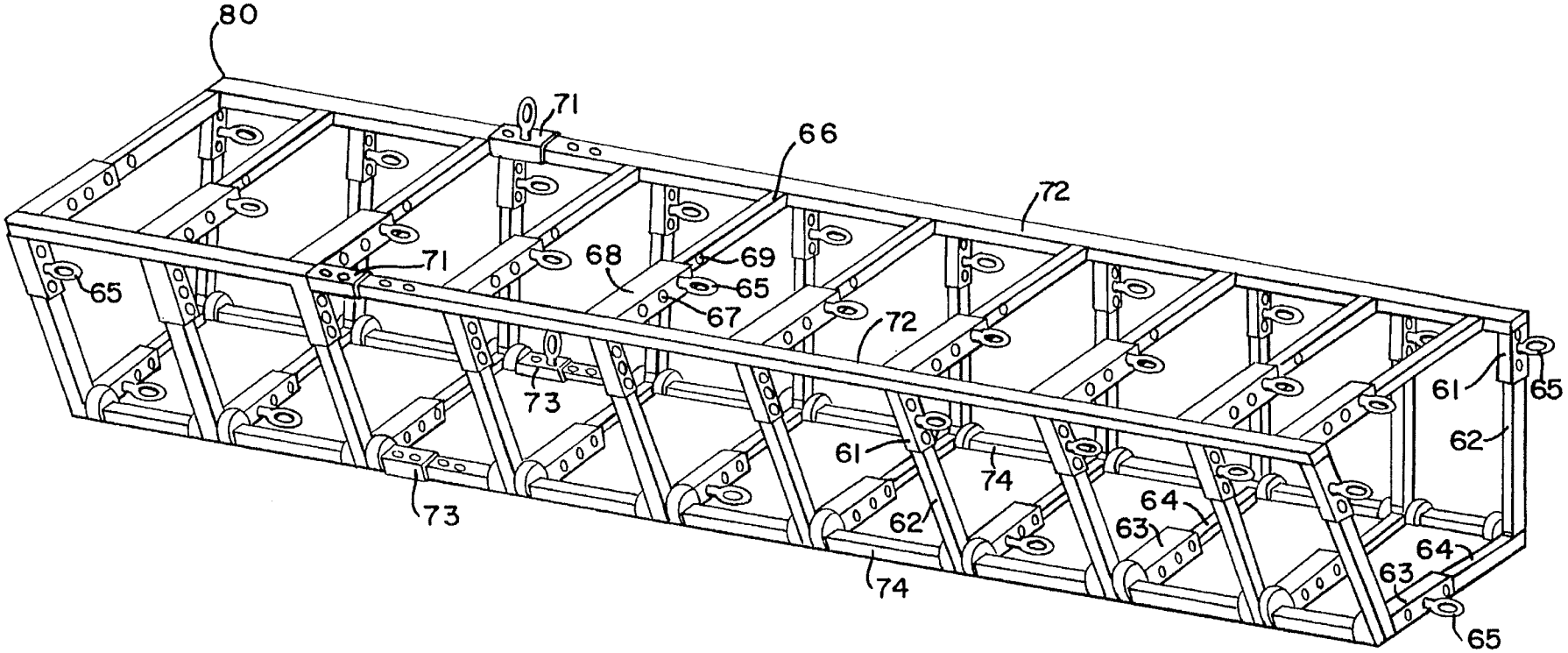
FIG. 4 is a perspective view of an alternative embodiment of an adjustable frame in which multiple adjusting mechanisms permit adjustment of the frame in every direction.

FIG. 4 illustrates an adjustable frame 80 which is similar to the frame 60 of FIG. 3 except that adjusting mechanisms are present not only on the upper cross-beams 66, but also on the upright beams 62, the lower cross-beams 64, the upper long beams 72 and the lower long beams 74. The upright beams 62 are telescopically engaged to mating beams 61 to permit adjustment of the frame height. The upper long beams 72 are telescopically engaged to mating beams 71, and the lower long beams 74 are telescopically engaged to mating beams 73, to permit adjustment of the frame length. The lower cross-beams 64 are telescopically engaged to mating beams 63, to permit further adjustment of the frame width in addition to the adjustment obtained using the upper cross-beams 66 and mating beams 68. Each of the beams, and corresponding mating beams, includes a plurality of openings as needed, into which pins 65 can be inserted to ensure the proper adjustment. By employing the invention in its various aspects, it becomes possible to adapt a single adjustable form to sizes smaller than a wide variety of metal containment devices having different sizes and shapes.

While the embodiments of the invention disclosed herein are presently considered to be preferred, various improvements and modifications can be made without departing from the spirit and scope of the invention. The scope of the invention is indicated in the appended claims, and all changes that fall within the meaning and range of equivalents are intended to be embraced therein.

We claim:

1. A mold structure for forming a refractory lining in a metal containment device, comprising:

a metal containment device including a floor and one or more walls; and an adjustable form suspended in the metal containment device at a distance from the floor and walls;

the adjustable form and the floor and walls of the metal containment device defining a space therebetween for the pouring of a refractory material;

the adjustable form including an adjustable frame and a consumable form comprising an open-mesh screen wrapped around the adjustable frame.

2. The mold structure of claim 1, wherein the adjustable frame comprises a plurality of intersecting upright beams, lower cross-beams and upper cross-beams; the upright beams being pivotally mounted relative to the lower cross-beams; the upper cross-beams being affixed to the upright beams and adjustable to a plurality of different positions using an adjusting mechanism.

3. The mold structure of claim 2, wherein the adjusting mechanism comprises a plurality of openings in an upper cross-beam, an end opening in an upright beam alignable with a selected one of the openings in the upper cross-beam, and a removable pin passing through the selected opening in the upper cross-beam and the aligned end opening in the upright beam.

4. The mold structure of claim 3, wherein the adjusting mechanism is present in a plurality of upper cross-beams and intersecting upright beams.

5. The mold structure of claim 2, wherein the upper cross-beams overhang the walls of the metal containment device, causing the adjustable form except for the upper cross-beams to hang into the metal containment device from the upper cross-beams.

6. The mold structure of claim 1, wherein the adjustable frame comprises a plurality of intersecting upright beams, lower cross-beams, upper cross-beams, and mating beams engaging the upper cross-beams; the upright beams being pivotally mounted relative to the lower cross-beams; the upper cross-beams and mating beams being engaged to the upright beams and adjustable relative to each other using an adjusting mechanism.

7. The mold structure of claim 5, wherein the upper cross-beams and mating beams are telescopically engaged to each other.

8. The mold structure of claim 5, wherein the adjusting mechanism comprises a plurality of openings in at least one upper cross-beam and engaging mating beam, the openings in the upper cross-beam and engaging mating beam being alignable in a plurality of different positions; and a removable pin passing through an opening in the upper cross-beam and an aligned opening in the engaging mating beam.

9. The mold structure of claim 8, wherein the adjusting mechanism is present in a plurality of upper cross-beams and engaging mating beams.

10. The mold structure of claim 1, wherein the consumable form is held to the adjustable frame using a plurality of straps.

11. The mold structure of claim 1, wherein the consumable form further comprises a liner.

12. A mold structure for forming a refractory lining in a metal containment device, comprising:

a metal containment device including a floor and one or more walls; and an adjustable form in the metal containment device at a distance from the floor and walls;

the adjustable form and the floor and walls of the metal containment device defining a space therebetween for the formation of a refractory liner;

the adjustable form including an adjustable frame comprising a plurality of intersecting beams, and a form comprising an open-mesh screen connected to the adjustable frame.

13. The mold structure of claim 12, wherein the adjustable frame comprises a plurality of lower cross-beams, a plurality of upright beams pivotally mounted relative to the lower cross-beams, and a plurality of adjustable upper cross-beams engaged to the upright beams.

14. The mold structure of claim 13, wherein the lower cross-beams are adjustable.

15. The mold structure of claim 13, wherein the upright beams are adjustable.

16. The mold structure of claim 13, wherein the adjustable frame further comprises a pair of lower long beams extending the length of the frame and intersecting the lower cross-beams and upright beams.

17. The mold structure of claim 16, wherein the lower long beams are adjustable.

18. The mold structure of claim 13, wherein the adjustable frame further comprises a pair of upper long beams extending the length of the frame and intersecting the upper cross-beams and upright beams.

19. The mold structure of claim 18, wherein the upper long beams are adjustable.

20. A method of forming or repairing a refractory lining in a molten metal containment device, comprising the steps of:

providing a molten metal containment device including a floor and one or more walls;

providing a frame including a plurality of adjustable beams;

adjusting the frame to a size smaller than the molten metal containment device;

cladding the frame with a form, and connecting the form comprising an open-mesh screen to the frame;

suspending the adjustable frame and form in the molten metal containment device at a distance from the floor and walls of the molten metal containment device; and injecting a refractory material between the form and the molten metal containment device.

* * * * *